US012419489B2

(12) United States Patent
Park et al.

(10) Patent No.: US 12,419,489 B2
(45) **Date of Patent: *Sep. 23, 2025**

(54) DISHWASHER

(71) Applicant: LG ELECTRONICS INC., Seoul (KR)

(72) Inventors: Hyung Man Park, Seoul (KR); Jeongkon Kim, Seoul (KR); Min Jae Jeong, Seoul (KR); Jeong In Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 380 days.

This patent is subject to a terminal disclaimer.

(21) Appl. No.: 18/079,283

(22) Filed: Dec. 12, 2022

(65) Prior Publication Data

US 2023/0210344 A1 Jul. 6, 2023

(30) Foreign Application Priority Data

Dec. 31, 2021 (KR) ..... 10-2021-0194348

(51) Int. Cl.
*A47L 15/48* (2006.01)
*A47L 15/42* (2006.01)

(52) U.S. Cl.
CPC ..... *A47L 15/488* (2013.01); *A47L 15/4257* (2013.01); *A47L 15/486* (2013.01)

(58) Field of Classification Search
CPC ... A47L 15/486; A47L 15/4257; A47L 15/488
See application file for complete search history.

(56) References Cited

U.S. PATENT DOCUMENTS 2,918,068 A * 12/1959 Karig ..... A47L 15/483 34/90
3,064,662 A * 11/1962 Given ..... A47L 15/46 134/108

(Continued)

FOREIGN PATENT DOCUMENTS

CA 2199095 A * 9/1997 ..... A47L 15/4257
CA 2597854 A1 * 3/2008 ..... A47L 15/4257

(Continued)

OTHER PUBLICATIONS

Machine Translation of KR 20070120254 to Yoon, Dec. 2007. (Year: 2007).*

(Continued)

*Primary Examiner* — Benjamin L Osterhout
(74) *Attorney, Agent, or Firm* — Fish & Richardson P.C.

(57) ABSTRACT

A dishwasher includes a tub that defines a washing space configured to accommodate objects to be washed, a door coupled to a front of the tub, and a drying device disposed at the door and configured to guide (i) wet air discharged from the inside of the tub and (ii) ambient air introduced from an outside of the tub. The drying device includes a bracket that defines a space configured to receive the wet air and the ambient air, where the bracket defines a first inlet that is in fluid communication with the outside and configured to receive the ambient air from the outside. The drying device further includes a cover coupled to the bracket and an impeller coupled to the bracket and configured to cause the wet air and the ambient air to be mixed, where the impeller is configured to generate a flow of the mixed air.

20 Claims, 14 Drawing Sheets

(56) References Cited

U.S. PATENT DOCUMENTS

| | | | | | |
|---|---|---|---|---|---|
| 3,117,582 | A * | 1/1964 | Perl | A47L 15/488 | 134/182 |
| 3,908,681 | A * | 9/1975 | Schimke | A47L 15/486 | 34/233 |
| 8,757,179 | B2 * | 6/2014 | Wetzel | A47L 15/48 | 134/102.3 |
| 8,758,525 | B2 * | 6/2014 | Kim | A47L 15/488 | 134/99.1 |
| 2004/0163689 | A1 * | 8/2004 | Lee | A47L 15/4223 | 134/186 |
| 2006/0231122 | A1 * | 10/2006 | Stelzer | A47L 15/486 | 134/25.2 |
| 2007/0006898 | A1 * | 1/2007 | Lee | A47L 15/0034 | 134/25.2 |
| 2008/0072935 | A1 * | 3/2008 | Han | A47L 15/486 | 134/104.2 |
| 2008/0087307 | A1 * | 4/2008 | Han | A47L 15/486 | 134/104.4 |
| 2008/0264455 | A1 * | 10/2008 | Brewer | A47L 15/483 | 134/95.2 |
| 2015/0320289 | A1 * | 11/2015 | Stutts | A47L 15/488 | 134/184 |
| 2015/0359412 | A1 * | 12/2015 | Delgado | A47L 15/4463 | 134/198 |
| 2016/0022115 | A1 * | 1/2016 | Vallejo Noriega | A47L 15/486 | 34/443 |
| 2016/0022116 | A1 * | 1/2016 | Delellis | A47L 15/486 | 34/218 |
| 2017/0319045 | A1 * | 11/2017 | Wu | A47L 15/488 | |
| 2019/0335974 | A1 * | 11/2019 | Kopera | A47L 15/4251 | |
| 2019/0350432 | A1 * | 11/2019 | Kopera | A47L 15/486 | |
| 2020/0100644 | A1 * | 4/2020 | Kopera | A47L 15/488 | |

FOREIGN PATENT DOCUMENTS

| | | | | | |
|---|---|---|---|---|---|
| CH | 683819 | A5 * | 5/1994 | A47L 15/483 | |
| CN | 1875869 | A * | 12/2006 | | |
| CN | 101267760 | A * | 9/2008 | A47L 15/0015 | |
| CN | 107981818 | A * | 5/2018 | A47L 15/4257 | |
| DE | 3901170 | A * | 7/1990 | A47L 15/488 | |
| DE | 19805227 | A1 * | 6/1999 | A47L 15/483 | |
| DE | 102007019298 | A1 * | 10/2007 | A47L 15/4251 | |
| EP | 521815 | A1 * | 1/1993 | A47L 15/4257 | |
| EP | 1230891 | A1 * | 8/2002 | A47L 15/486 | |
| EP | 1961362 | A2 * | 8/2008 | A47L 15/0013 | |
| EP | 1551272 | B1 * | 2/2012 | A47L 15/0034 | |
| EP | 3263005 | A1 * | 1/2018 | A47L 15/0026 | |
| EP | 3469977 | A1 * | 4/2019 | A47L 15/0028 | |
| EP | 3622875 | B1 * | 11/2022 | A47L 15/0044 | |
| KR | 20070120254 | | 12/2007 | | |
| WO | WO-2004019750 | A1 * | 3/2004 | A47L 15/0034 | |
| WO | WO-2016083615 | A1 * | 6/2016 | A47L 15/0036 | |
| WO | WO-2017052796 | A1 * | 3/2017 | | |

OTHER PUBLICATIONS

Machine Translation of WO 2016083615 to Doppelbauer et al., Jun. 2016 (Year: 2016).*
Machine Translation of EP 3622875 to Bertram et al., Nov. 2022. (Year: 2022).*
Machine translation of EP 1961362 to Gonska et al., Aug. 2008. (Year: 2008).*
Machine Translation of EP 1230891 A1 to Ennen et al., Jan. 2002. (Year: 2002).*
Machine Translation of EP 1551272 B1 to Lilja, Aug. 2003. (Year: 2003).*
Machine Translation of EP 0521815 A1 to Huettemann et al., Jun. 1992. (Year: 1992).*
Machine Translation of DE 3901170 A1 to Stamminger et al., Jul. 1990. (Year: 1990).*
Machine Translation of DE 19805227 A1 to Schmid et al., Feb. 1998. (Year: 1998).*
Machine Translation of DE 102007019298 to Lee, Apr. 2007. (Year: 2007).*
Machine Translation of CN 1875869 to Lee, Jun. 2005. (Year: 2005).*
Machine Translation of CN 107981818 A to Zeng et al., Dec. 2017. (Year: 2017).*
Machine Translation of CN 101267760 A to Shin et al., Sep. 2008. (Year: 2008).*
Machine Translation of CH 683819 A5 to Voegl et al., May 1994. (Year: 1994).*

* cited by examiner

DISHWASHER

CROSS-REFERENCE TO RELATED APPLICATION

This application claims priority to and benefit of Korean Patent Application No. 10-2021-0194348, filed on Dec. 31, 2021, which is hereby incorporated by reference as if fully set forth herein.

TECHNICAL FIELD

The present disclosure relates to a dishwasher, more particularly, a dishwasher including a drying device.

BACKGROUND

A dishwasher is an electric appliance configured to wash dishes provided as washing targets by spraying wash water. In some cases, wash water used for dishwashing may include a dishwashing detergent.

By using the dishwasher, the time and effort for washing dishes that are washing targets after eating may be reduced, thereby contributing to user's convenience.

In some cases, the dishwasher may include a drying device. The drying device may be configured to operate after a heating and rinsing process configured to rinse the dishes stored in the tub by heating wash water in a washing process. For instance, a drying device may continuously lower the humidity inside the tub by mixing the humid air flowing in from the inside of the tub and the dry air flowing in from the outside of the tub and discharging the mixed air to the outside of the dishwasher. The drying device may discharge steam from the inside to the outside of the tub and vaporize the wash water remaining on surfaces of the dishes stored in the tub, only to dry the dishes.

The drying device may receive dry air, which is relatively dry, from the outside of the dishwasher and wet air, which is relatively humid, from the tub. The dry and the wet air are mixed in the drying device and the mixed air may be discharged to the outside of the drying device. The wet air flowing in from the tub to the drying device may be relatively high temperature and the dry air flowing in the drying device from the outside may be relatively low temperature.

When the high temperature wet air and the low temperature dry air are mixed, condensation may occur in the wash water existing in a vapor state in the high-temperature wet air to make a condensate that is condensed water. The condensate may be condensed on an inner wall of the drying device and fall by gravity. The condensed water falling by gravity may accumulate on the floor of the location where the dishwasher is installed through an outlet of the mixed air. The accumulated condensate might cause inconvenience in that the user has to manually remove and wipe it out.

To suppress the occurrence of dew condensation in the drying device, the mixing of the dry air and the wet air should occur smoothly inside the drying device. If the wet air and the dry air are hardly mixed inside the drying device, the wet air in an almost unmixed state might be condensed on an inner wall of the drying device due to high humidity, which might cause serious condensation inside the drying device.

In some cases, a motor for rotating a fan may be mounted in the drying device. Due to water vapor in the air flowing inside the drying device, and dew condensation inside the drying device, the motor may malfunction. In some cases, an inlet may be defined in the drying device to receive dry air from the outside. Water may be discharged to the outside of the drying device through such an inlet and the discharged water may affect electrical components disposed outside the drying device.

SUMMARY

The present disclosure describes a dishwasher including a drying device with a structure configured to smoothly mix dry air (ambient air) and wet air therein.

The present disclosure further describes a dishwasher having a structure configured to suppress a motor provided in a drying device from submerging and malfunctioning.

The present disclosure further describes a dishwasher having a structure configured to suppress water leaking from the inside of the drying device to electronic components disposed in the outside of the drying device.

According to one aspect of the subject matter described in this application, a dishwasher includes a tub that defines a washing space configured to accommodate objects to be washed, a door coupled to a front of the tub and configured to open and close the tub, and a drying device disposed at the door and configured to dry an inside of the tub, where the drying device is configured to guide (i) wet air discharged from the inside of the tub and (ii) dry air (ambient air) introduced from an outside of the tub. The drying device includes a bracket that defines a space configured to receive the wet air and the dry air, where the bracket defines a first inlet that is in fluid communication with the outside and configured to receive the dry air from the outside. The drying device further includes a cover coupled to the bracket and an impeller coupled to the bracket and configured to cause the wet air and the dry air to be mixed, where the impeller is configured to generate a flow of the mixed air.

Implementations according to this aspect can include one or more of the following features. For example, the first inlet can pass through the bracket and be defined at a position upstream relative to an inlet of the impeller. In some examples, the bracket can further define a second inlet spaced apart from the first inlet and configured to receive the wet air from the tub, the second inlet being in fluid communication with the tub, where a flow direction of the dry air through the first inlet crosses a flow direction of the wet air through the second inlet.

In some implementations, the drying device can further include a valve mechanism coupled to the bracket and disposed in a flow path of the wet air. The valve mechanism can be configured to open and close the second inlet and include a valve portion configured to move toward and away from the second inlet, a valve control module disposed outside the bracket and coupled to the valve portion and configured to control operation of the valve portion, and an opening/closing portion coupled to the valve portion and configured to open and close the second inlet based on the operation of the valve portion.

In some examples, the bracket can include a first blocking wall that protrudes from an outer surface of the bracket and surrounds at least a portion of the first inlet. In some examples, a least a portion of the first blocking wall can be disposed between the first inlet and the valve control module, where the first blocking wall is configured to block the wet air discharged through the first inlet from flowing toward the valve control module. In some implementations, the first blocking wall can include a first cell disposed between the first inlet and the valve control module, and a second cell that extends from an end of the first cell and is curved around the first inlet.

In some implementations, the bracket can include a casing that defines a mounting space of the impeller, where the mounting space includes a first through-hole that is open in a direction of a rotational axial of the impeller. In some examples, the bracket can define a communication hole that surrounds the first through-hole and passes through the bracket, where the communication hole is in fluid communication with the impeller and an outside of the bracket. In some examples, the drying device can further include a motor coupled to a shaft of the impeller and configured to rotate the impeller, where the communication hole is one of a plurality of communication holes that are arranged around the motor.

In some implementations, the drying device can include a valve coupled to the bracket and disposed in a flow path of the wet air, where the valve is configured to open and close the second inlet, a duct that is in fluid communication with the bracket and an outlet of the cover, the duct defining a passage configured discharge the mixed air from the impeller to the outside of the tub, and an air guide disposed between the bracket and the cover and configured to guide the flow of the mixed air into the impeller, where the impeller is rotatably coupled to the air guide.

In some examples, the bracket can include a first communication portion that defines a space that is in fluid communication with the cover, a partition wall that defines the second inlet and partitions off the first communication portion from an inner space of the bracket, and a first outlet that is in fluid communication with an inlet of the duct and configured to discharge the mixed air having passed through the impeller. In some examples, the cover can include a second communication portion that is coupled to the first communication portion and defines a space in fluid communication with the bracket, and a third inlet that enables fluid communication between the second communication portion and the tub, where the third inlet is configured to supply the wet air from the tub to the drying device.

In some implementations, the bracket can further include a second blocking wall that protrudes from an inner surface of the bracket and surrounds at least a portion of the first inlet. In some examples, a least a portion of the second blocking wall can be disposed between the first inlet and the valve control module and configured to block a condensate on the inner surface of the bracket from discharging through the first inlet. In some examples, the second blocking wall can include a first part disposed between the first inlet and the valve control module, and a second part that extends from a lower end of the first part and surrounds at least a portion of the first inlet.

In some implementations, the bracket can further include a first support portion that is disposed at the inner surface of the bracket and protrudes from the second blocking wall toward the cover. In some examples, the first support portion can be disposed above the second inlet.

In some examples, the cover can include a second support portion that is disposed at an inner surface of the cover and protrudes from the inner surface of the cover toward the bracket. In some examples, the first inlet can be one of a plurality of first openings arranged along a vertical direction, and the second inlet can be one of a plurality of second openings arranged along a horizontal direction orthogonal to the vertical direction, where the plurality of second openings are disposed below the plurality of first openings.

In some implementations, the dry air and the wet air can be mixed to be the mixed air at a position before flowing into the impeller. The mixed air can be more mixed while passing through the impeller, to remarkably enhance the mixing efficiency of the dry air and the wet air.

In some implementations, the flow directions at the position where the dry air and the wet air meet cross each other so that the dry air and the wet air can be noticeably increased. Since the mixed sufficiently mixed is introduced into the duct, dew condensation inside the duct can be effectively suppressed.

In some implementations, the dry air flowing in through the communication hole can effectively suppress the mixed air containing more water vapor from getting in contact with the motor. Accordingly, the water vapor contained in the mixed air can be effectively suppressed from penetrating the bearing and other components of the motor.

In some implementations, the first blocking wall can block the wet air discharged through the first inlet from flowing to the valve control module, thereby effectively suppressing corrosion of the valve control module due to the wet air.

In some implementations, the second blocking wall can effectively block the condensate generated on the inner wall of the bracket from flowing to the outside through the first inlet. Accordingly, flow of the condensate into the valve control module through the first inlet can be blocked and the corrosion of the valve control module caused by the condensate can be effectively suppressed.

Specific effects are described along with the above-described effects in the section of Detailed Description.

DETAILED DESCRIPTION

Figure 1:
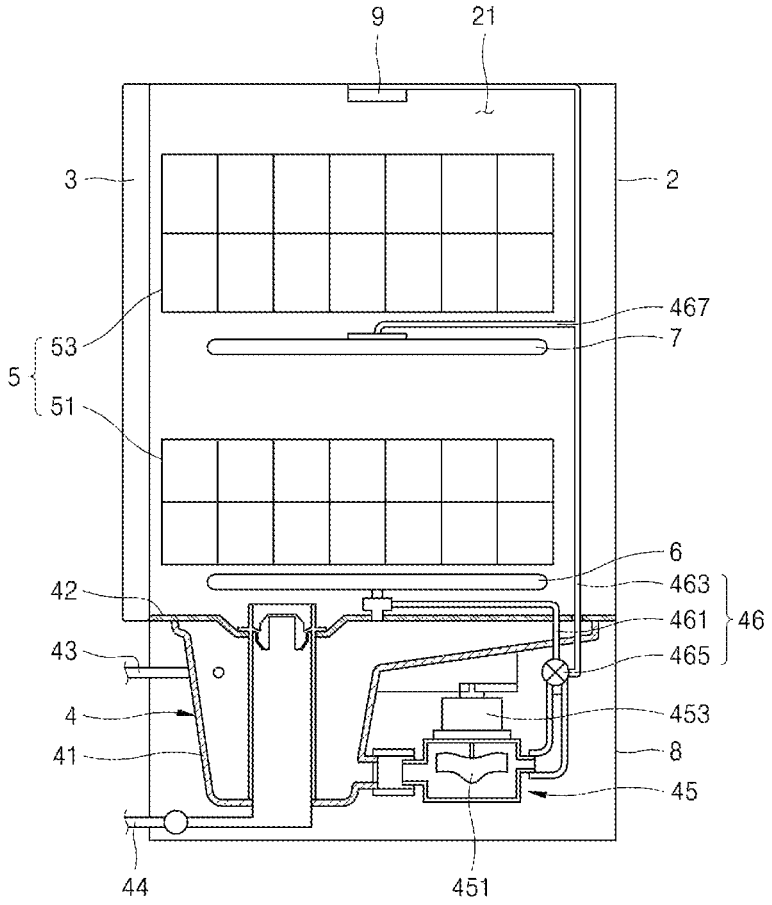
FIG. 1 is a sectional view schematically showing an example of a dishwasher.

The above-described aspects, features and advantages are specifically described hereunder with reference to the accompanying drawings such that one having ordinary skill in the art to which the present disclosure pertains can easily implement the technical spirit of the disclosure. In the drawings, identical reference numerals can denote identical or similar components.

Throughout the present disclosure, "up-down direction (or a vertical direction)" refers to an up-and-down direction of a dishwasher that is installed for daily use. "Left-right direction (or horizontal direction)" refers to a direction orthogonal to the up-down direction, and "front-back direction refers to a direction orthogonal to both the up-down direction and the left-right direction. "Both side directions" or "lateral directions" have the same meaning as the left-right direction. These terms can be used interchangeably herein.

FIG. 1 is a sectional view schematically showing an example of a dishwasher.

In some implementations, referring to FIG. 1, the dishwasher can include a housing defining an exterior of the dishwasher, a tub 2 defining a washing space 21 inside the housing and configured to receive dishes as washing targets, a door 3 rotatably coupled to a base 8 and configured to selectively open and close the washing space 21, a sump 4 provided in a lower area of the tub 2 and configured to store wash water, a storage part 5 provided inside the tub 2 and configured to store the washing targets, and spray arms 6, 7, and 9 configured to spray wash water toward the washing targets stored in the storage part 5. For example, dishes can include bowls, plates, spoons, chopsticks or other cooking utensils, for example.

The tub 2 can define the washing space 21 and receive dishes. The storage part 5 and the spray arms 6, 7, and 9 can be provided inside the washing space 21. The tub has one open surface and the open surface can be closable by the door 3.

The door 3 can be rotatably coupled to the housing and configured to selectively open and close the washing space. For example, a lower portion of the door 3 can be coupled to the housing by a hinge. For instance, the door 3 can be rotatably on the hinge to open and close the tub 2. When the door 3 is opened, the storage part 5 can be drawn to the outside of the dishwasher and the drawn storage part 5 can be supported by the door 3.

The sump 4 can include a storage portion 41 configured to store wash water, a sump cover 42 configured to partition off the storage portion 41 from the tub 2, a water supply portion 43 configured to supply wash water to the storage portion 41 from the outside, a water discharge portion 44 configured to discharge the wash water from the storage portion 41, and a water supply pump 45 and a water supply path 46 that are configured to supply the wash water stored in the storage portion 41 to the spray arms 6, 7, and 9.

The sump cover 42 can be disposed on a top of the sump 4 and configured to separate the sump 4 from the tub 2. In addition, the sump cover 42 can include a plurality of water collection holes configured to recollect the wash water sprayed to the washing space 21 through the spray arms 6, 7, and 9.

Specifically, the wash water sprayed from the spray arms 6, 7, and 9 can fall down to the bottom of the washing space 21 and pass through the sump cover 42 to be recollected in the storage portion 41 of the sump 4.

The water supply pump 45 can be provided in a side area or a lower area of the storage portion 41 and configured to supply wash water to the spray arms 6, 7, and 9.

The water supply pump 45 can have one end connected to the storage portion 41 and the other end connected to the water supply path 46. An impeller 451 and a motor 453 can be provided inside the water supply pump 45. When electricity is supplied to the motor 453, the impeller 451 can be rotated and the wash water of the storage portion 41 can be supplied to the spray arms 6, 7, and 9 through the water supply path 46.

The water supply path 46 can be configured to selectively supply the wash water flowing in from the water supply pump 45 to the spray arms 6, 7, and 9.

The water supply path 46 can include a first water supply path 461 connected to a lower spray arm 6, a second water supply path 463 connected to an upper spray arm 7 and a top nozzle 9, and a water supply path switching valve 465 configured to selectively open and close the water supply paths 461 and 467. For instance, the water supply path switching valve 465 can be controlled to sequentially or simultaneously open the water supply paths 461 and 463.

At least one storage part 5 can be provided in the washing space 21 to store dishes. In some examples, two storage parts 5 can be provided in the dishwasher as shown in FIG. 1, but the present disclosure is not limited thereto.

As one example, the dishwasher can include only one storage part or three or more storage parts. In some examples, the number of the spray arms can be variable based on the number of the storage parts.

The storage part 5 can include a lower rack 51 and an upper rack 53 to store dishes. The lower rack 51 can be disposed in the washing space 21 and dishes can be stored in the lower rack 51. The upper rack 53 can be disposed above the lower rack 51 and dishes can be stored in the upper rack 53. Here, a top rack can be disposed between a space between a top of the upper rack 53 and a top nozzle 9, and dishes can be stored in the top rack.

The lower rack 51 can be disposed above the sump 4 and the upper rack 53 can be positioned higher than the lower rack 51. The lower rack 51, the upper rack 53 and the top rack can be movable to the outside through the open surface of the tub 2.

To this end, a rail type holder can be provided on an inner surface of the tub 2. Wheels can be provided on a lower surface of the rack 51 and 53. The user can store dishes or take out the washed dishes by withdrawing the storage part 5 to the outside.

The spray arm can be provided inside the tub 2 and configured to spray wash water toward the dishes stored in the storage part 5. The spray arm can include a lower spray arm 6, an upper spray arm 7, and a top nozzle 9.

The lower spray arm 6 can be rotatably provided below the lower rack 51 and configured to spray to the dishes. The upper spray arm 7 can be rotatably provided between the upper spray arm 7 and the lower rack 51 and configured to spray wash water to the dishes.

The lower spray arm 6 can be rotatably coupled to a top of the sump cover 42 and configured to spray wash water toward the dishes stored in the lower rack 51. The upper spray arm 7 can be disposed above the lower spray arm 6 and configured to spray wash water toward the dishes stored in the upper rack 53. The top nozzle 9 can be provided in an upper are of the washing space 21 and configured to spray wash water to the lower rack 51 and the upper rack 53.

As described above, the first water supply path 461 can be configured to supply wash water to the lower spray arm 6 and the second water supply path 463 can be configured to supply wash water to the upper spray arm 7 and the top nozzle 9.

Referring to FIG. 1, the dishwasher can include a base 8. The base 8 can be disposed underneath the tub 2 and the tub 2 can be secured to the base. The base 8 can provide a space in which the sump 4 is disposed, and also a space in which the pump, the dry air supplier and other various mechanisms are disposed.

Accordingly, the base 8 can have an outer wall to support the entire dishwasher and form a space to accommodate various devices.

Figure 2:
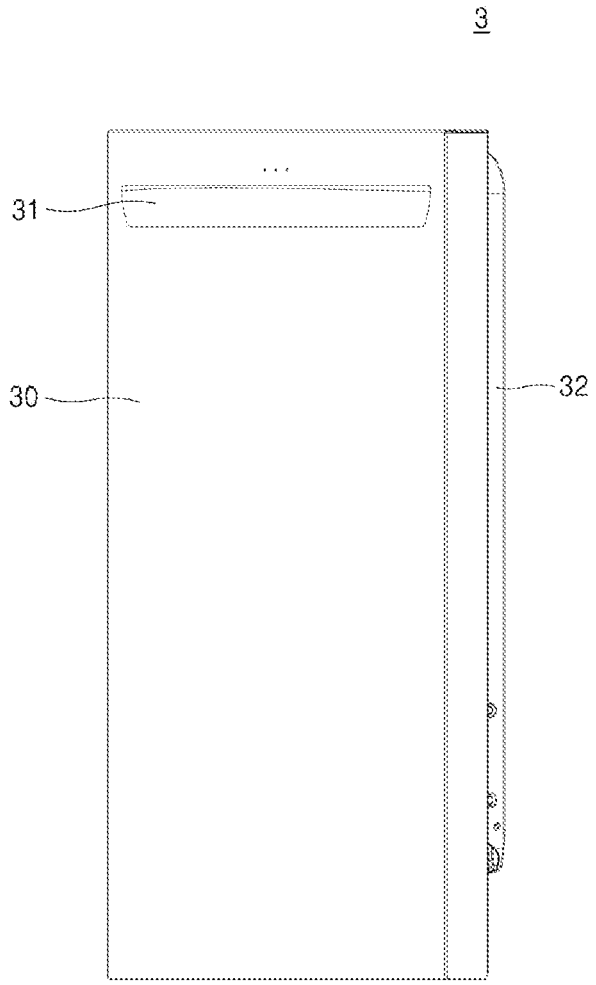
FIG. 2 is a perspective view showing an example of a door of the dishwasher.
Figure 3:
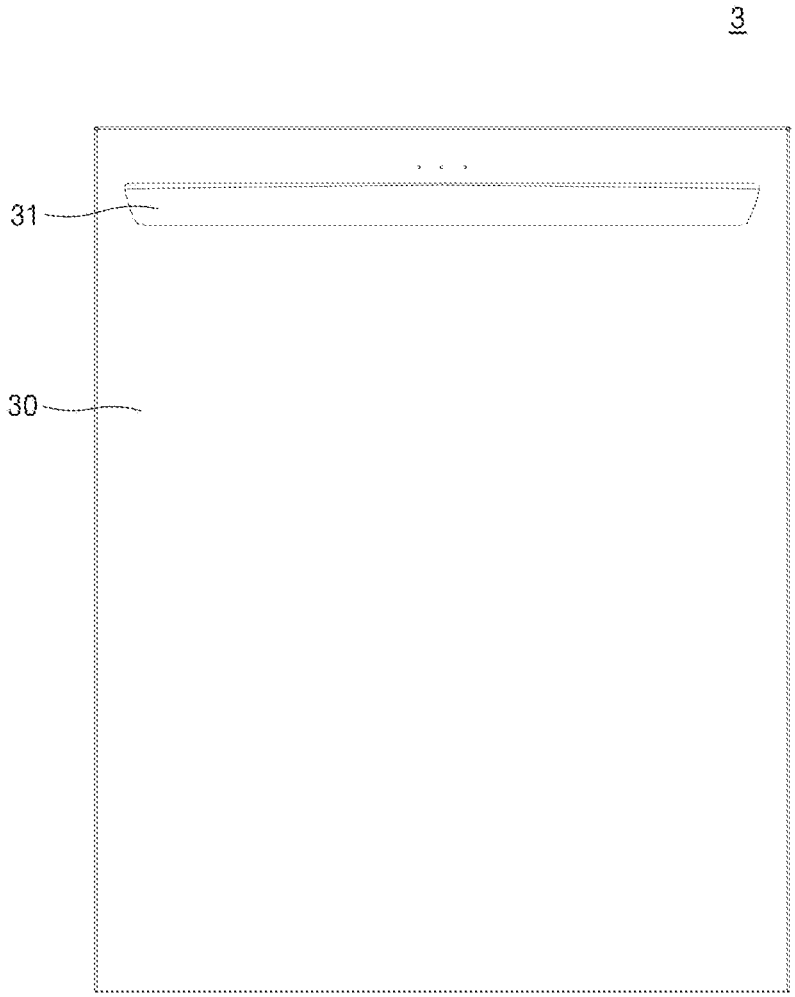
FIG. 3 is a front view of the door.
Figure 4:
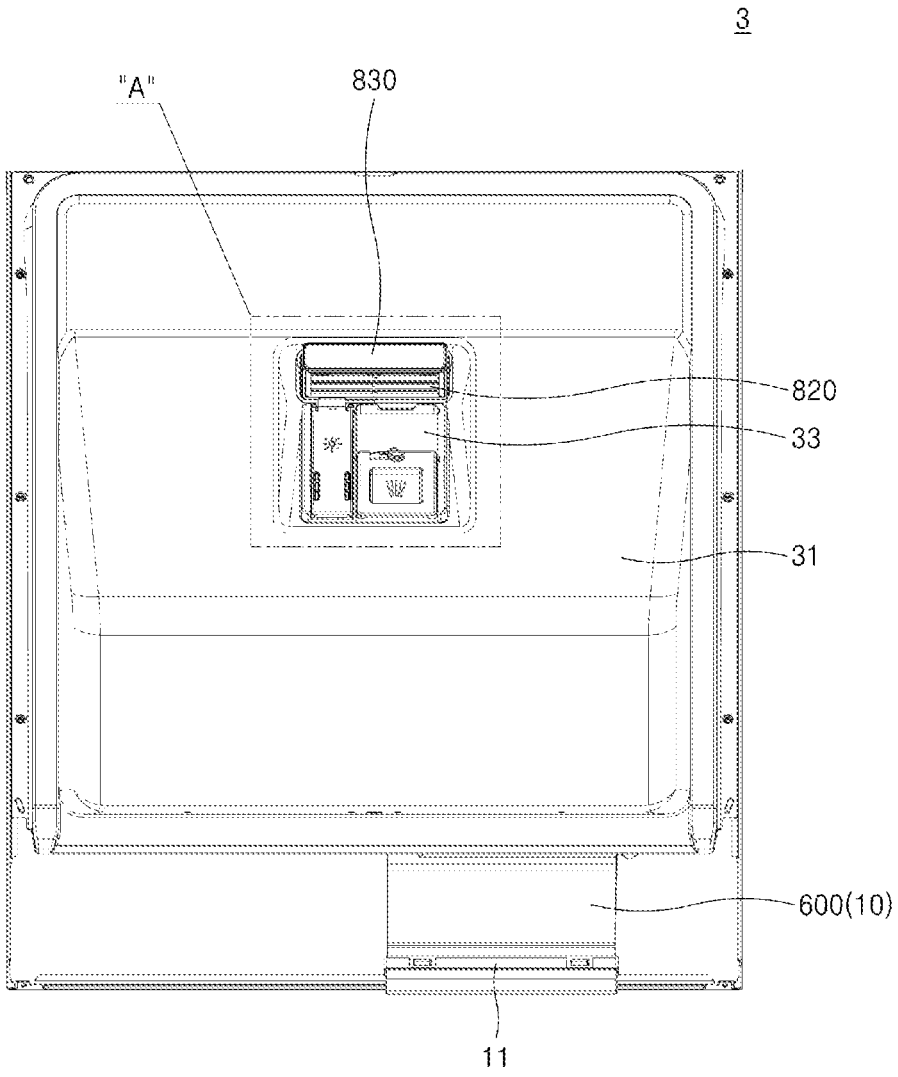
FIG. 4 is a rear view of the door.
Figure 5:
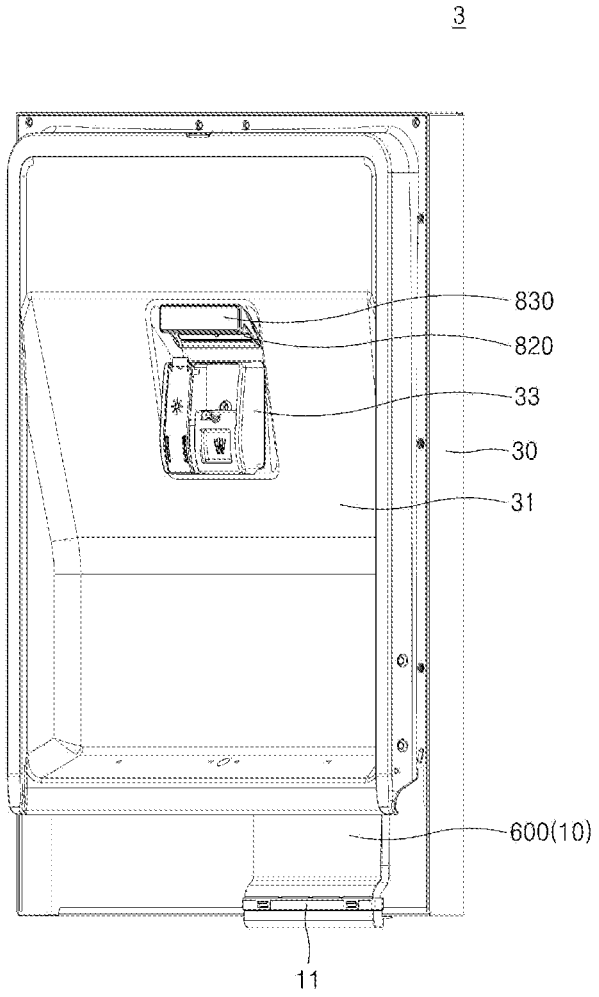
FIG. 5 is a rear perspective view of the door.
Figure 6:
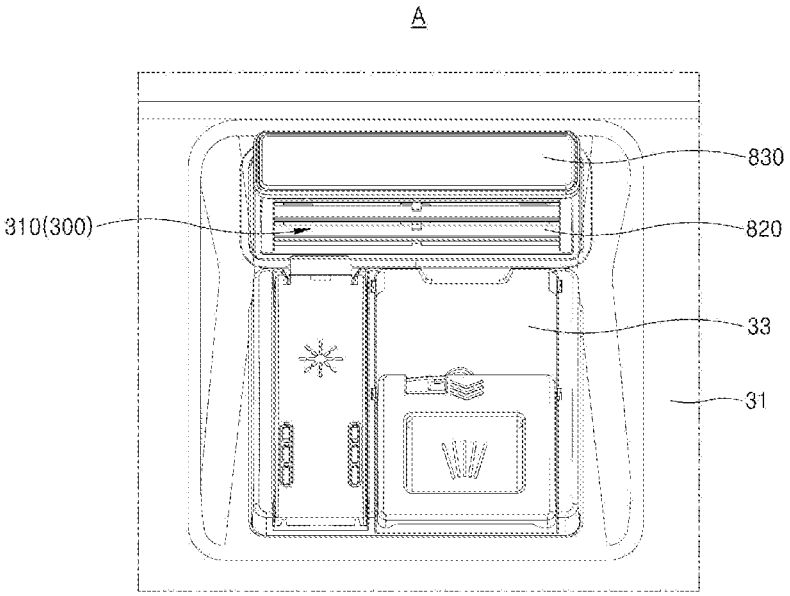
FIG. 6 is an enlarged view showing 'A' of FIG. 4.

FIG. 2 is a perspective view of a door 3. FIG. 3 is a front view of the door 3. FIG. 4 is a rear view of the door 3. FIG. 5 is a rear perspective view of the door 3. FIG. 6 is an enlarged view showing 'A' of FIG. 4.

The door 3 can be coupled to a front of the tub 2 and configured to open and close the tub 2. The door 3 can open and close the tub based on rotation with respect to the tub 2. A handle 31 can be secured to an outer surface of the door 3 so that the user can open and close the door 3, with holding the handle.

The door 3 can include a body 30 and a liner 32. The body 30 can be disposed in an outer area of the door 3 and the handle 31 can be secured to the body 30.

When the door 3 is closed to close the tub 2, the liner 32 can be configured to seal between the tub 2 and the body 30 of the door 3 so that the wash water inside the tub 2 may not leak to the outside of the dishwasher.

Accordingly, the liner 32 can be secured to an inner surface of the door 3 to seal between the tub 2 and the door 3. In some examples, an accommodation mechanism 33 can be provided on an inner surface of the liner 32 and a dishwashing detergent accommodated in the accommodation mechanism 33 can be introduced into the tub 2 as much as needed to be mixed with wash water.

A space can be defined between the liner 32 of the door 3 and the body 30 and the drying device 10 can be provided inside the space. A drying process can be performed by discharging water vapor inside the tub to the outside by operating the drying device 10 provided in the dishwasher.

The drying device 10 can be secured to the door 3 and configured to discharging the wet air flowing in from the inside of the tub 2 and the dry air flowing in from the outside of the tub 2, to as dry the inside the tub 2.

The drying device 10 can be mounted in a space defined between the body 30 and the liner 32. A mount portion 11 can be secured to a lower surface of the duct 600 and mounted to a lower surface of the body 30 so that the duct 600 can be stably secured to the lower area of the door 3.

Hereinafter, the wet air refers to air with a high humidity that flows in the drying device 10 from the inside of the tub 2. The dry air refers to air with a low humidity around the dishwasher that flows into the drying device 10 from the outside of the tub 2. The humidity of the wet air can be higher than that of the dry air.

In the following, unless otherwise specified, humidity refers to absolute humidity and relative humidity. In addition, mixed air refers to air that is made by mixing the wet air and the dry air described above with each other in the drying device 10. The humidity of the mixed air can be lower than that of the wet air and higher than the dry air.

The drying device 10 can operate after a heating and rinsing operation for rinsing the dishes stored in the tub 2 by heating wash water during a washing operation is performed.

The drying device 10 can be configured to mix the wet air flowing in from the inside of the tub 2 and the dry air flowing in from the outside of the tub 2 and then to discharge the mixed air to the outside of the dishwasher, thereby constantly lowering humidity inside the tub 2.

Accordingly, the drying device 10 can dry the dishes by discharging water vapor inside the tub 2 to the outside and evaporating wash water remaining on surfaces of the dishes stored inside the tub 2.

In some implementations, a third inlet 310 can be defined in the drying device 10 and configured to facilitate communication between the tub 2 and the inside of the drying device 10. The wet air inside the tub 2 can be introduced into the drying device 10 through the third inlet 310.

The third inlet 310 can be disposed on a surface directed from the liner 32 toward the tub 2. The drying device 10 can include a mesh member 820 coupled to the drying device 10 at a position corresponding to the third inlet 310.

The mesh member 820 can include a plurality of ribs. Accordingly, wet air can be introduced into the drying device 10 through the third inlet 310 but relatively large objects can be blocked from flowing into the drying device 10 by the mesh member 820.

The mesh member 820 can block a large object inside the tub 2 from flowing into the drying device 10. In addition, the mesh member 820 can suppress the user's finger from being suctioned into the drying device 10 through the third inlet 310 when the user touches the communication hole with the finger.

The drying device 10 can include a packing member 810 (see FIG. 10) and a name plate 830. The packing member 810 can be disposed between the mesh member 820 and a surface of the liner 32 and configured to seal a gap between the mesh member 820 and the surface of the liner 32.

The name plate 830 can be coupled to a predetermined area of the mesh member 820. The name plate 830 can be coupled to the predetermined area of the mesh member 820 not to cover the third inlet 310. The name and function of the drying device 10 can be written on the name plate 830.

Figure 7:
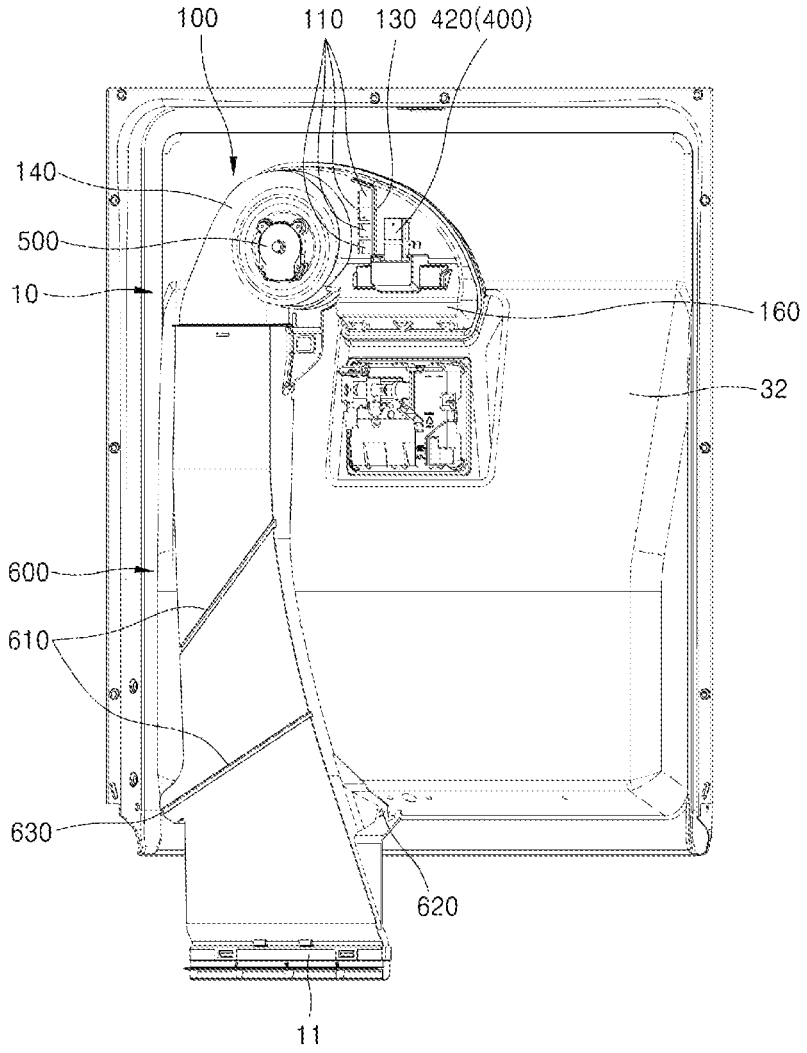
FIG. 7 shows an example showing an example of a door body of the door.
Figure 8:
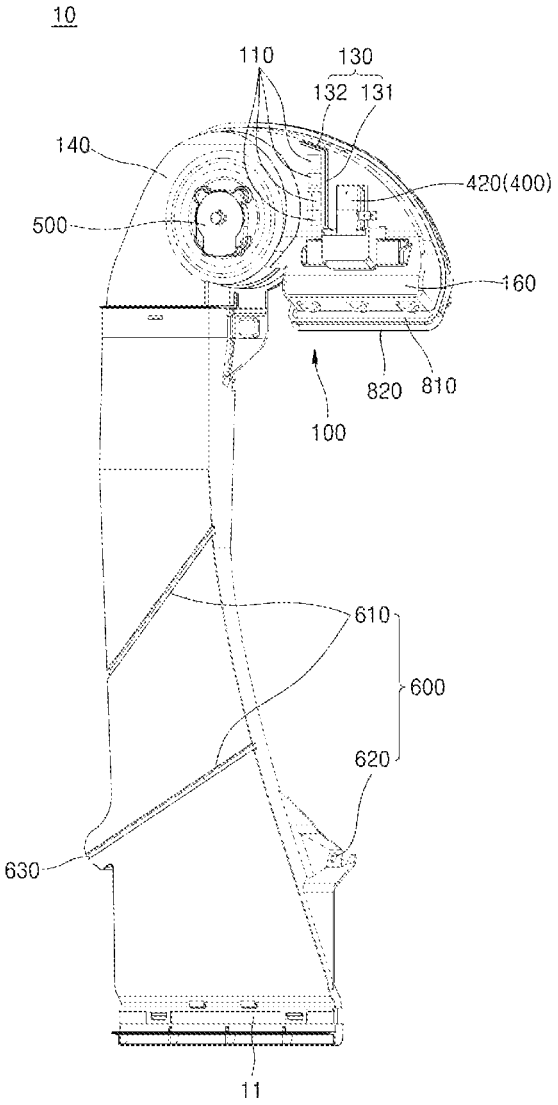
FIG. 8 is a perspective view showing an example of a drying device.
Figure 9:
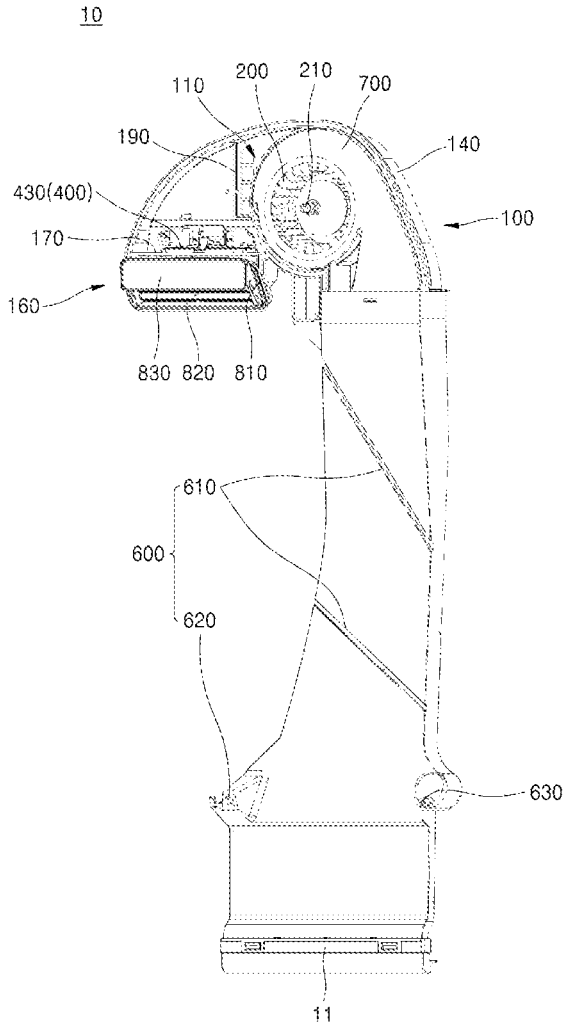
FIG. 9 is a view of FIG. 8, viewed in a different direction, without a cover.

FIG. 7 shows a door body 30 cut away from the door 3. FIG. 8 is a perspective view showing the drying device 10. FIG. 9 is a view of FIG. 8, viewed in a different direction, without a cover. A cover 300 is omitted in FIG. 9.

Figure 10:
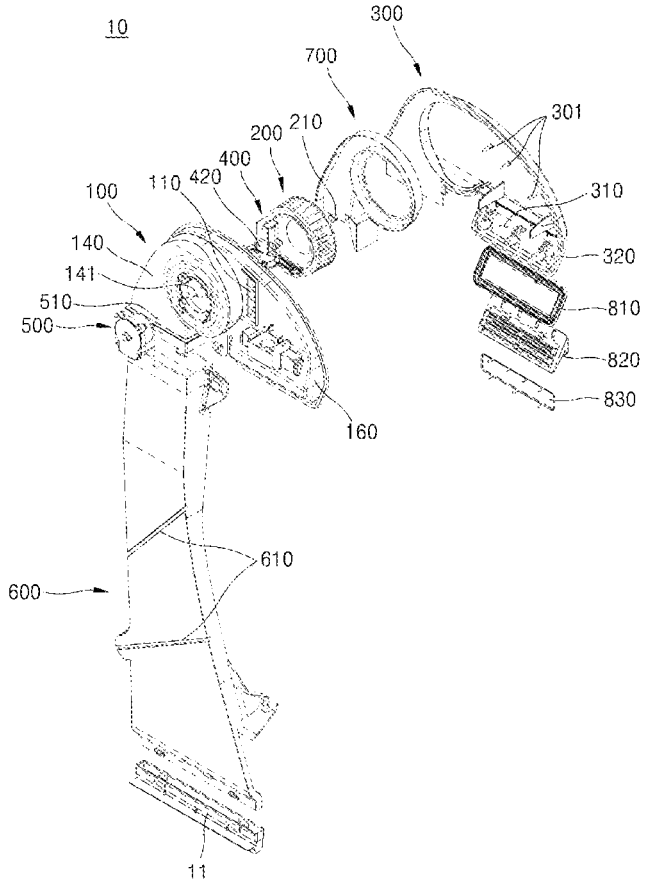
FIG. 10 is an exploded perspective view showing the drying device.
Figure 11:
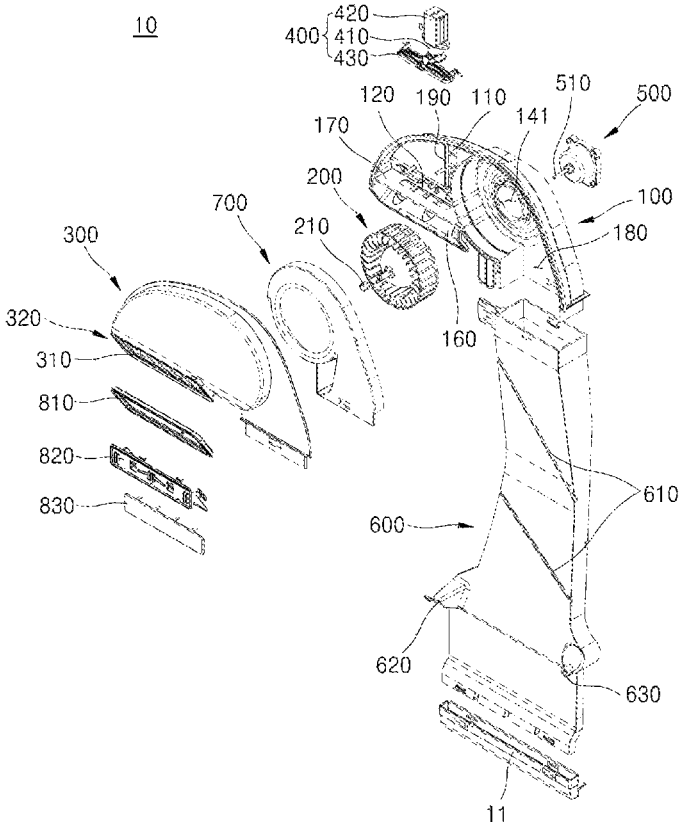
FIG. 11 is a view of FIG. 10, viewed in a different direction.

FIG. 10 is an exploded perspective view showing the drying device 10. FIG. 11 is a view of FIG. 10, viewed in a different direction.

In some implementations, the drying device 10 can include a bracket 100, an impeller 200 and a cover 300. The bracket 100 can be configured to provide a certain space in which the wet air and the dry are flow.

The wet air and the dry air can separately flow in the bracket 100, and can be mixed to be the mixed air before flowing in the impeller 200 from the inside of the bracket 100. The mixed air can be more mixed to be introduced into the duct 600, while passing through the impeller 200.

The impeller 200 can be secured to the bracket 100 and configured to forcibly flow the mixed air made from the wet air and the dry air. The wet air and the dry air can be introduced into the bracket 100 by the impeller 200 to be mixed. The mixed air can be discharged to the outside of the duct 600 through the bracket 100, the impeller 200 and the duct 600 sequentially.

The cover 300 can be coupled to the bracket 100 and configured to receive a valve mechanism 400 and the impeller 200. The cover 300 coupled to the bracket 100 can provide an airflow space in which the wet air and the dry air flow.

The cover 300 can include a second support portion 301. The second support portion 301 can protrude from an inner wall of the cover 300 toward the bracket 100, and can be provided in plural. The plurality of second support portions 301 can be spaced an appropriate distance apart from each other.

The second support portion 301 can stably support the components mounted in the drying device 10, together with the first support portion 101 disposed in the bracket 100.

The bracket 100 can include a first inlet 110 disposed to communicate with the outside of the drying device 10 and receive the dry air. The first inlet 110 can be directly connected to the atmosphere so that ambient air can be introduced into the drying device 10 through the first inlet 110. The dry air can be the ambient atmosphere.

Referring to FIG. 8, the first inlet 110 can include a plurality of holes penetrating the bracket 100. The plurality of the holes constituting the first inlet 110 can be spaced apart from each other and disposed in a vertical direction of the bracket 100. As the impeller 200 rotates, dry air can flow in the bracket 100 through the first inlet 110 and can be mixed with wet air to be the mixed air. The mixed air can flow into the impeller 200.

The bracket 100 can include a second inlet 120 spaced apart from the first inlet 110, in communication with the tub 2, and configured to receive the wet air. The second inlet 120 can be closed and opened by the valve mechanism 400.

When the drying device 10 operates, the valve mechanism 400 can open the second inlet 120 and wet air inside the tub 2 can flow into the bracket 100 through the second inlet 120 to be mixed with dry air.

The drying device 10 can include the valve mechanism 400, the duct 600 and an air guide 700.

The valve mechanism 400 can be secured to the bracket 100 and disposed in a path of the wet air, and can be configured to open and close the second inlet 120.

The valve mechanism 400 can open and close the second inlet 120 to allow wet air to flow into the drying device 10 from the duct 600 through the second inlet or block the wet air flow. In some implementations, the valve mechanism 400 can be provided in plural and some of the valve mechanism 400 can be open or all of the valve mechanism 400 can be open.

Accordingly, the plurality of valve mechanisms 400 can adjust an open rate of the second inlet 120 to control the flow rate of the wet air flowing into the drying device 10 from the tub 2. Hereinafter, an example having one valve mechanism 400 will be described.

The duct 600 can communicate with the bracket 100 and an outlet of the cover 300, and can provide a passage for discharging the mixed air to the outside from the impeller 200. An inlet of the duct 600 can be in communication with a first outlet 180 and an outlet of the duct 600 can be directly connected to the atmosphere. Accordingly, the mixed air discharged from the outlet of the duct 600 can be more humid than ambient air.

The duct 600 can have an inducing portion 610 and a recollecting hole 630. A plurality of inducing portions 610 can be disposed on an inner wall of the duct 600 in a direction in which the mixed air flows, and configured to drop the condensate generated on the inner wall of the duct 600 to the lower area. The recollecting hole 630 can be defined below the inducting portion 610, in communication with the tub, and configured to provide a passage along which the dropped condensate is recollected in the tub 2.

In some examples, the plurality of inducing portions 610 can include a plurality of protrusions protruded toward the inside of the duct and spaced a predetermined distance apart from each other along the flowing direction of the mixed air. The inducing portion 610 can be disposed, with a longitudinal direction that is inclined with respect to a direction in which gravity acts. The recollecting hole 630 can be disposed at a position corresponding to a lowermost end of the inducing portion 610 so that the condensed falling along the inducing portion 610 can easily reach the recollecting hole 630.

Dew condensation may occur in that water is condensed from the mixed air flowing inside the duct 600 to generate dew on the inner wall of the duct 600. While falling by gravity, the condensate generated on the inner wall can flow downward along the longitudinal direction of the inducing portion 610 protruded from the inner wall of the duct 600, and can be collected in the lower area of the duct 600.

The condensate collected in the lower area of the duct 600 can flow through the recollecting hole 630. A hose, for example, can be secured to the recollecting hole 630 and the hose can be in communication with the inside of the tub 2.

Accordingly, the condensate flowing downward along the inducing portion 610 can sequentially pass through the recollecting hole 630 and the hose, to be recollected in the tub 2. The condensate recollected inside the tub 2 can be introduced into the sump disposed below the tub 2. Due to this structure, the condensate generated on the inner wall of the duct 600 can be recollected in the tub 2.

In some examples, the duct 600 can have a coupling hole 620 formed at a position distant from the recollecting hole 630 and a coupling member such as a bolt for coupling the duct 600 to the door 3 can be coupled to the coupling hole 620.

The air guide 700 can be disposed between the bracket 100 and the cover 300 so that the impeller 200 can be rotatably coupled to the air guide, and can be configured to guide the flow of the mixed air introduced into the impeller 200.

The air guide 700 can guide the mixed air forcibly flowing by the impeller 200 to flow along a preset flow direction and seal the impeller 200 to suppress the wet air from leaking to another space after escaping the preset flow passage between the bracket 100 and the cover 300.

The bracket 100 can include a first communication portion 160, a partition wall 170 and a first outlet 180. The first communication portion 160 can form a space that is in communication with the cover 300. The first communication portion 160 can be coupled to a second communication portion 320 disposed in the cover 300 to define a flow space of wet air. The wet air flowing into the airflow space can flow in the impeller 200 through the second inlet 120.

The second inlet 120 can be defined in the partition wall 170 and the partition wall 170 can be configured to partition off the first communication portion 160 from the inner space of the bracket 100. Referring to FIG. 11, the first communication portion 160 and the inner space of the bracket 100 can be separated by the partition wall 170, and a plurality of second inlets 120 can be defined in the partition wall 170. The plurality of second inlets 120 can be opened and closed by an opening/closing portion 430 of the valve mechanism 400.

The first outlet 180 can be configured to discharge the mixed air having passed the impeller 200. The first outlet 180 can be coupled to the cover 300 to form an area for discharging the mixed air. Accordingly, an outlet having a shape corresponding to the first outlet 180 can be defined even in the cover 300.

The cover 300 can include a second communication portion 320 and a third inlet 310. The second communication portion 320 can be coupled to the first communication portion 160 and configured to form a space that is in communication with the bracket 100. The third inlet 310 can be configured to facilitate communication between the second communication portion 320 and the tub 2 so that the wet air can flow into the drying device 10 from the tub 2.

When the impeller 200 operates in a drying process, the wet air inside the duct 600 can be introduced into the bracket 100 after sequentially passing through the third inlet 310, the space in which the first communication portion 160 and the second communication portion 320 are defined, and the second inlet 120.

The valve mechanism 400 can include a valve portion 410, a valve control module 420, and an opening/closing portion 430. The valve portion 410 can be configured to operate the opening/closing portion 430 to open and close the second inlet 120 provided in the bracket 100.

The valve control module 420 can be secured to the valve portion 410 and configured to control the operation of the valve portion 410. The valve control module 420 can operate the valve portion 410 and the valve portion 410 can operate the opening/closing portion 430, to open and close the second inlet 120.

The opening/closing portion 430 can be coupled to the valve portion 410 and configured to get in contact with the partition wall 170 or get distant from the partition wall 170 based on the operation of the valve portion 410, to open and close the second inlet 120.

When the dishwasher performs the drying process, the opening/closing portion 430 can be spaced apart from the partition wall 170 by the valve control module 420 and then the second inlet 120 can be open so that wet air can flow into the drying device 10 through the second inlet 120.

When the drying process of the dishwasher is completed, the opening/closing portion 430 can get in contact with the partition wall 170 by the valve control module 420 and then the second inlet 120 can be closed so that wet air inside the tub 2 can be blocked from flowing into the drying device 10.

The bracket 100 can include a casing 140 configured to form a mounting space of the impeller 200 and having a first through-hole 141 in a rotation axial direction of the impeller 200. The casing 140 can be integrally formed with the bracket 100.

In some examples, a motor 500 can be coupled to a shaft of the impeller 200 and configured to rotate the impeller 200. The impeller 200 can be secured to the casing 140 inside the bracket 100, and some area of the motor 500 can be exposed to the outside.

The motor 500 can be inserted in the first through-hole 141 to be coupled to the impeller 200 and some area of the motor 500 can be exposed to the outside of the casing 140 to be coupled to the casing 140 of the bracket 100 at a position adjacent to the first through-hole 141.

The wet air flowing into the drying device 10 from the tub 2 can be relatively high temperature and the dry air flowing into the drying device 10 can be relatively low temperature.

When the high temperature wet air and the low temperature dry air are mixed, condensation may occur in the wash water existing in a vapor state in the high-temperature wet air to make a condensate that is condensed water. The condensate can be condensed on an inner wall of the drying device 10 and fall by gravity.

The condensed water falling by gravity may accumulate on the floor of the location where the dishwasher is installed through an outlet of the mixed air. The accumulated condensate might cause inconvenience in that the user has to manually remove and wipe it out. Accordingly, there is a need of a structure configured to suppress the occurrence of dew condensation in the drying device 10.

In order to suppress the occurrence of dew condensation in the drying device 10, it is appropriate that the mixing of dry air and wet air occurs smoothly inside the drying device 10.

If wet air and dry air are hardly mixed in the drying device 10, the wet air in a state of being hardly mixed may be condensed on an inner wall of the drying device 10 due to its high humidity, thereby causing serious dew condensation inside the drying device 10.

Hereinafter, there will be described a structure according to the present disclosure that is configured to facilitate smooth mixing of the wet air flowing in from the tub 2 and the dry air flowing from the outside of the drying device 10.

Figure 12:
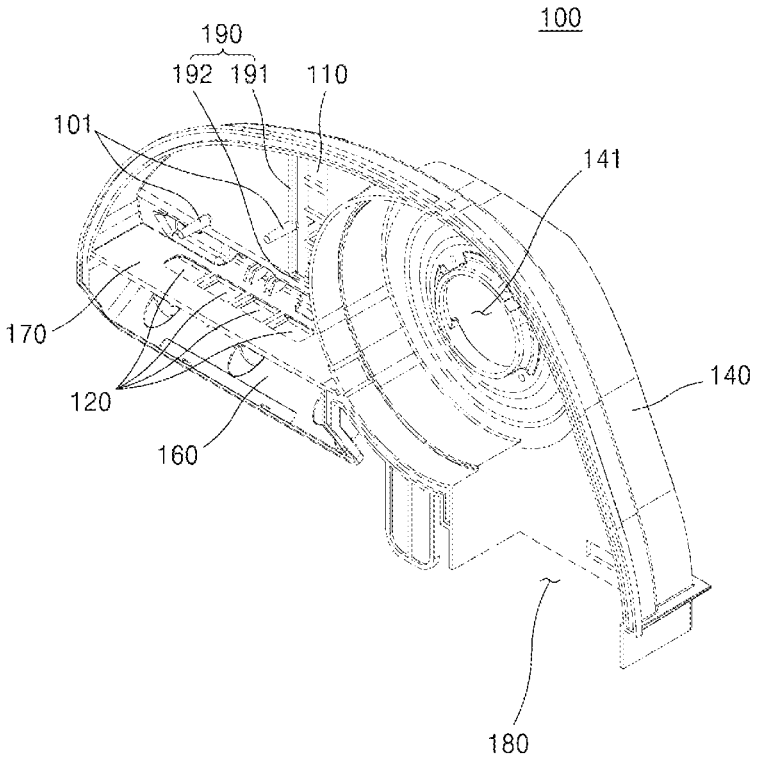
FIG. 12 is a perspective view showing an example of a bracket of the drying device.

FIG. 12 is a perspective view showing an example of the bracket 100.

In some examples, the bracket 100 can include a first support portion 101. The first support portion can protrude toward the cover 300 from an inner wall of the bracket 100, and can be provided in plural. The plurality of first support portions 101 can be spaced a preset distance apart from each other.

The first support portion 101 can stably support the components mounted in the drying device 10, together with a second support portion 301 disposed in the cover 300. At least one of the plurality of first support portions 101 can overlap with a second blocking wall 190.

Specifically, the first support portion can protrude from the second blocking wall 190. The first support portion 101 can have a thin long shape to have a relatively weak rigidity. The first support portion 101 can overlap with the second blocking wall 190 so that the rigidity of the first support portion 101 can be reinforced and damage to the first support portion 101 due to the weak rigidity may be prevented.

The first inlet 110 can be disposed at a position in front of an entrance of the impeller 200 with respect to the flow path of the dry air.

Accordingly, the dry air flowing into the bracket 100 through the first inlet 110 and the wet air flowing into the bracket 100 through the second inlet 120 can met each other before they flow in the impeller 200. In other words, the dry air and the wet air before flowing in the impeller 200 can meet each other to be the mixed air.

Due to this structure, the dry air and the wet air can be mixed to be the mixed air, before flowing into the impeller 200. While passing through the impeller 200, the dry air and wet air contained in the mixed air can be more mixed to be mixed air that is mixed more uniformly.

The flow direction of the dry air in the first inlet 110 can cross the flow direction of the wet air in the second inlet 120.

The wet air passing through the second inlet 120 can flow along a vertical direction of the bracket 100. The first inlet 110 can penetrate the bracket 100 in a lateral direction of the bracket 100. Accordingly, the dry air introduced into the bracket 100 through the first inlet 110 can flow along the lateral direction of the bracket 100.

Accordingly, the dry air and the wet air can have the flow directions that cross each other at a point where they meet. When the flow directions of the dry and the wet air cross each other, the mixing efficiency of the dry air and the wet air can be more enhanced, compared with the flow directions parallel to each other.

When the flow directions cross each other, the dry air and the wet air can flow in the respective flow paths crossing each other. Accordingly, the dry air and the wet air can be more mixed as cutting off the flow paths, compared to flow directions that are parallel to each other.

In some implementations, the dry air and the wet air can be mixed to be the mixed air at a position before flowing into the impeller 200. The mixed air can be more mixed while passing through the impeller 200, to remarkably enhance the mixing efficiency of the dry air and the wet air.

In some implementations, the flow directions at the position where the dry air and the wet air meet cross each other so that the dry air and the wet air can be noticeably increased.

Since the mixed sufficiently mixed is introduced into the duct 600, dew condensation inside the duct 600 can be effectively suppressed.

Figure 13:
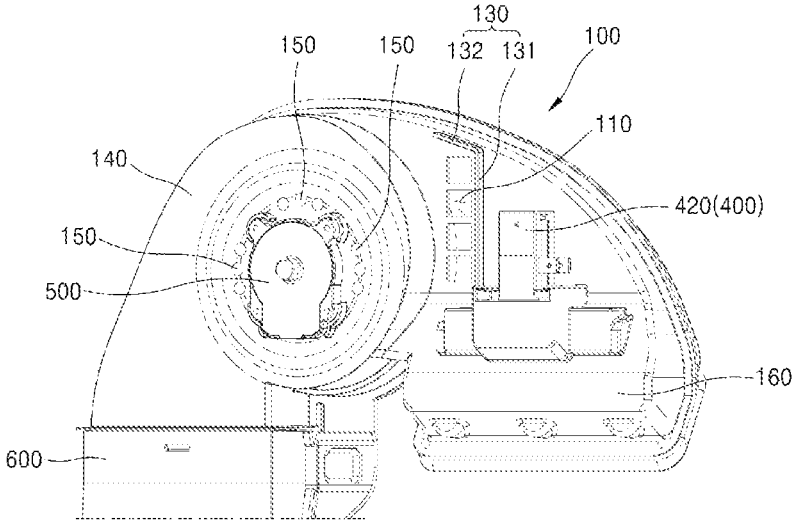
FIG. 13 is a partially enlarged view of the drying device.
Figure 14:
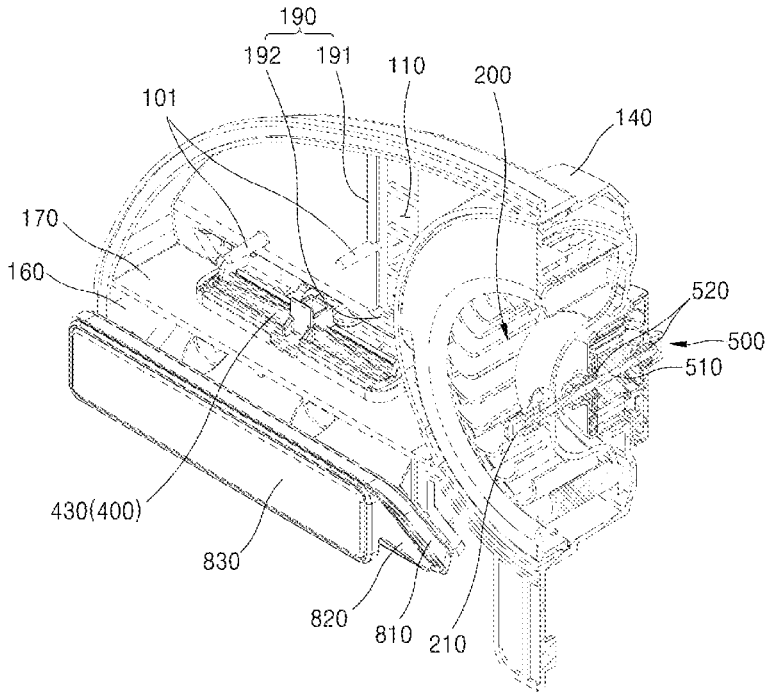
FIG. 14 is a partially enlarged sectional perspective view of the drying device.
Figure 15:
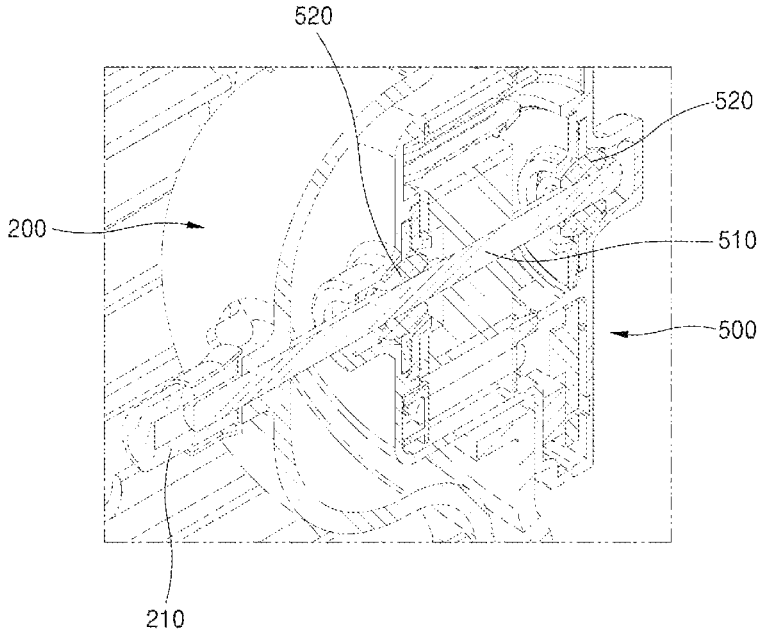
FIG. 15 is a partially enlarged view of FIG. 14.
Figure 16:
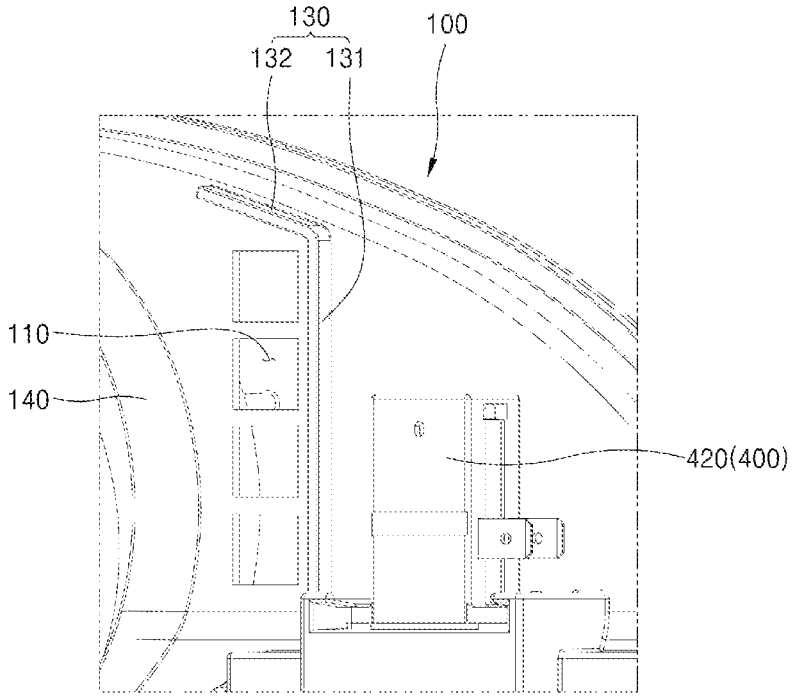
FIG. 16 is a partially enlarged view of FIG. 13.

FIG. 13 is a partially enlarged view of the drying device 10. FIG. 14 is a partially enlarged sectional perspective view of the drying device 10. FIG. 15 is a partially enlarged view of FIG. 14. FIG. 16 is a partially enlarged view of FIG. 13.

Due to water vapor contained in the air flowing inside the drying device 10 and dew condensation inside the drying device 10, the motor 500 might be submerged in the water and malfunction.

Referring to FIG. 14, the impeller 200 can include a first shaft 210 protruding from the impeller 200. The first shaft 210 can be provided in a rotational center of the impeller 200. In addition, the motor 500 can include a second shaft 510 provided in a rotational center of the impeller 200.

The first shaft 210 can be hollow and the second shaft 510 can be fitted to the hollow of the first shaft 210, to couple the motor 500 to the impeller 200. Accordingly, as the second shaft 510 of the motor 500 rotates, the first shaft 210 and the impeller 200 can rotate together.

The motor 500 can include a bearing 520 configured to support the second shaft 510. The condensate generated due to water vapor contained in the air flowing inside the drying device 10 and dew condensation inside the drying device 10 might penetrate the bearing 520.

The water vapor and condensate penetrating into the bearing 520 might corrode the bearing and other parts of the motor 500. Accordingly, there is a need of a structure configured to suppress the corrosion of the bearing 520 of the motor 500 and other parts.

The bracket 100 can include a communication hole 150 that surrounds the first through-hole 141, penetrates the bracket 100, and is configured to facilitate communication of the impeller 200 with the outside. The communication hole 150 can pass through the casing 140. The communication hole 150 can be provided to surround the motor 500.

The communication hole 150 can be provided in plural, and the plurality of communication holes 150 can be disposed to surround the motor 500 and the number of the communication holes can be appropriately selected.

Outside air, that is, dry air can be introduced into the impeller 200 and the motor 500 through the communication hole 150. When the impeller 200 is rotated by the operation of the motor 500, a pressure lower than the ambient atmospheric pressure can be formed inside the casing to which the impeller 200 is secured.

Specifically, a negative pressure or zero pressure (gauge pressure) can be formed in an inner space of the casing 140 in which the impeller 200 is disposed. Accordingly, when the impeller 200 is rotated, dry air can be introduced into the impeller 200 and the motor 500 through the communication hole 150.

The dry air flowing into the impeller 200 and the motor 500 can be mixed with the mixed air inside the space where the impeller 200 and the motor 500 are mounted, to lower the humidity of the mixed air.

In particular, since the communication hole 150 is provided to surround the motor 500, the dry air introduced through the communication hole 150 can immediately surround the motor 500. Accordingly, the dry air flowing through the communication hole 150 can effectively block the mixed air containing more water vapor from get in contact with the motor 500

Specifically, the dry air flowing through the communication hole 150 can effectively suppress the mixed air containing more water vapor from contacting with the motor 500, thereby effectively suppressing the water vapor contained in the mixed air from penetrating the bearing 520 of the motor 500 and other components.

The dry air introduced into the impeller 200 and the motor 500 through the communication hole 150 can eventually be mixed with the mixed air and discharged to the duct 600.

As shown in FIG. 13, at least predetermined area of the valve control module 420 can be disposed outside the bracket 100 to be connected to an external power supply, a communication wire and etc.

The water vapor contained in the bracket 100 of the drying device 10 and the condensate condensed on the inner wall of the bracket 100 can be discharged to the outside through the first inlet. In some examples, the discharged water might penetrate the components disposed outside the drying device 10, particularly, the valve control module 420, and might adversely affect the valve control module 420.

Referring to FIGS. 13 and 16, the bracket 100 can include a first blocking wall 130 provided to protrude from an outer surface of the bracket 100 and configured to surround at least predetermined area of the first inlet 110.

At least predetermined area of the first blocking wall 130 can be disposed between the first inlet 110 and the valve control module 420, to suppress the wet air discharged through the first inlet 110 from flowing toward the valve control module 420.

The wet air introduced into the drying device 10 from the tub 2 through the second inlet 120 can be partially discharged to the outside of the drying device 10 through the first inlet 110. The wet air discharged from the first inlet 110 might corrode components of the valve control module 420, when it flows to the valve control module 420.

Accordingly, the first blocking wall 130 can protrude to an outer surface of the bracket 100, and can be disposed between the first inlet 110 and the valve control module 420 to block the wet air discharged through the first inlet 110 from flowing to the valve control module 420.

In some examples, the height of the first blocking wall 130 can be selected appropriately to effectively block the airflow to the valve control module 420 from the first inlet 110 from the first inlet 110, and to prevent the overall volume of the bracket 100 from becoming excessively large.

The first blocking wall 130 can include a first cell 131 and a second cell 132. The first cell 131 can be disposed between the first inlet 110 and the valve control module 420. The second cell 132 can be bent from a lower end of the first cell 131 and configured to surround the first inlet 110.

The first cell 131 and the second cell 132 can be disposed to surround some area of the first inlet 110, to effectively block flow of wet air between the first inlet 110 and the valve control module 420.

The second cell 132 can be inclined with respect to a vertical direction of the bracket 100. In some examples, the second cell 132 can be disposed upward as getting closer to an end thereof.

Due to this structure, even if a condensate is generated on an upper surface or a lower surface of the second cell 132, the condensate can fall along the inclination of the second cell and flow into the first inlet again or fall below the bracket 100 along the first cell connected to the second cell 132. Accordingly, the condensate can be suppressed from flowing out from the first inlet 110 to the outside.

In addition, a control panel can be disposed on an upper portion of the door 3 and configured to control the dishwasher. The second cell 132 can block an upper area of the first inlet 110 to effectively prevent a condensate or wet air, which might leak into the control panel above the second cell 132 through the first inlet, from reaching the control panel.

In some implementations, the first blocking wall 130 can effectively block the wet air discharged through the first inlet 110 from flowing to the valve control module, thereby suppressing the valve control module 420 from being corroded by the wet air.

Referring to FIG. 14, the bracket 100 can include a second blocking wall 190 protruding from an inner surface of the bracket 100 and configured to surround at least predetermined area of the first inlet 110.

The first blocking wall 130 and the second blocking wall 190 can be configured to effectively reinforce the rigidity of the bracket 100, which becomes insufficient due to the formation of the first inlet.

At least predetermined area of the second blocking wall 190 can be disposed between the first inlet 110 and the valve control module 420 so suppress the condensate condensed on the inner wall of the bracket 100 from flowing out through the first inlet 110.

The condensate generated by the dew condensation can be stuck to the inner wall of the bracket 100. Some of such the condensate can be discharged to the outside of the drying device 10 through the first inlet 110. If the condensate discharged from the first inlet 110 can flow to the valve control module 420 along an outer surface of the bracket 100, the components of the valve control module 420 might be corroded.

Accordingly, the second blocking wall 190 can protrude from the inner surface of the bracket 100 and can be disposed between the first inlet 110 and the valve control module 420, to suppress the condensate from flowing out through the first inlet 110.

The second blocking wall 190 can suppress the condensate from flowing out through the first inlet 110, thereby effectively blocking the condensate discharged from the first inlet 110 from flowing to the valve control module 420.

In some examples, the height of the second blocking wall 190 can be selected appropriately, to effectively block the condensate from flowing out through the first inlet 110 from the inner wall of the bracket 100 without significantly impeding the flow of the dry air and the wet air inside the bracket 100.

The second blocking wall 190 can include a first part 191 and a second part 192. The first part 191 can be disposed between the first inlet 110 and the valve control module 420. The second part 192 can be bent from a lower end of the first part 191 and configured to surround the first inlet 110.

The first part 191 and the second part 192 can be configured to partially surround the first inlet 110 so that the condensate generated on the inner wall of the bracket 100 can flow out to the outside of the bracket 100 through the first inlet 110, thereby effectively blocking the condensate from flowing to the valve control module 420.

In some implementations, the second blocking wall 190 can be configured to block the condensate generated on the inner wall of the bracket 100 from being discharged to the outside through the first inlet 110. Accordingly, the condensate can be blocked from flowing to the valve control module after being discharged through the first inlet 110 to effectively suppress corrosion of the valve control module 420.

In some examples, the second part 192 can be disposed between the first inlet 110 and the third inlet 310. Accordingly, even if the wash water sprayed from the spray arms 6, 7 and 9 comes into the drying device through the mesh member 820, the third inlet 310 and the second inlet 120, the wash water can be prevented from flowing out through the first inlet 110.

The implementations are described above with reference to a number of illustrative implementations thereof. However, the present disclosure is not intended to limit the implementations and drawings set forth herein, and numerous other modifications and implementations can be devised by one skilled in the art. Further, the effects and predictable effects based on the configurations in the disclosure are to be included within the range of the disclosure though not explicitly described in the description of the implementations.

What is claimed is:

1. A dishwasher comprising:

a tub that defines a washing space configured to accommodate objects to be washed;

a door coupled to a front of the tub and configured to open and close the tub; and a drying device disposed at the door and configured to dry an inside of the tub, the drying device being configured to guide (i) wet air discharged from the inside of the tub and (ii) ambient air introduced from an outside of the tub, wherein the drying device comprises:

a bracket that defines a space configured to receive the wet air and the ambient air, the bracket defining a first inlet that is in fluid communication with the outside and configured to receive the ambient air from the outside, an impeller coupled to the bracket and configured to cause the wet air and the ambient air to be mixed, the impeller being configured to generate a flow of the mixed air, and a cover coupled to the bracket, wherein the bracket further defines a second inlet spaced apart from the first inlet and configured to receive the wet air from the tub, the second inlet being in fluid communication with the tub, and wherein the drying device further comprises a valve mechanism coupled to the bracket and disposed in a flow path of the wet air, the valve mechanism being configured to open and close the second inlet and comprising:

a valve portion configured to move toward and away from the second inlet, and an opening/closing portion coupled to the valve portion and configured to open and close the second inlet based on operation of the valve portion.

2. The dishwasher of claim 1, wherein the first inlet passes through the bracket and is defined at a position upstream relative to an inlet of the impeller.

3. The dishwasher of claim 2, wherein a flow direction of the ambient air through the first inlet crosses a flow direction of the wet air through the second inlet.

4. The dishwasher of claim 3, wherein further comprises a valve control module disposed outside the bracket and coupled to the valve portion, the valve control module being configured to control the operation of the valve portion.

5. The dishwasher of claim 4, wherein the bracket comprises a first blocking wall that protrudes from an outer surface of the bracket and surrounds at least a portion of the first inlet.

6. The dishwasher of claim 5, wherein a least a portion of the first blocking wall is disposed between the first inlet and the valve control module, the first blocking wall being configured to block the wet air discharged through the first inlet from flowing toward the valve control module.

7. The dishwasher of claim 6, wherein the first blocking wall comprises:

a first cell disposed between the first inlet and the valve control module; and a second cell that extends from an end of the first cell and is curved around the first inlet.

8. The dishwasher of claim 1, wherein the bracket comprises a casing that defines a mounting space of the impeller, the mounting space including a first through-hole that is open in a direction of a rotational axial of the impeller.

9. The dishwasher of claim 8, wherein the bracket defines a communication hole that surrounds the first through-hole and passes through the bracket, the communication hole being in fluid communication with the impeller and an outside of the bracket.

10. The dishwasher of claim 9, wherein the drying device further comprises a motor coupled to a shaft of the impeller and configured to rotate the impeller, and wherein the communication hole is one of a plurality of communication holes that are arranged around the motor.

11. The dishwasher of claim 3, wherein the drying device comprises:

a duct that is in fluid communication with the bracket and an outlet of the cover, the duct defining a passage configured to discharge the mixed air from the impeller to the outside of the tub; and an air guide disposed between the bracket and the cover and configured to guide the flow of the mixed air into the impeller, wherein the impeller is rotatably coupled to the air guide.

12. The dishwasher of claim 11, wherein the bracket comprises:

a first communication portion that defines a space that is in fluid communication with the cover;

a partition wall that defines the second inlet and partitions off the first communication portion from an inner space of the bracket; and a first outlet that is in fluid communication with an inlet of the duct and configured to discharge the mixed air having passed through the impeller.

13. The dishwasher of claim 12, wherein the cover comprises:

a second communication portion that is coupled to the first communication portion and defines a space in fluid communication with the bracket; and a third inlet that enables fluid communication between the second communication portion and the tub, the third inlet being configured to supply the wet air from the tub to the drying device.

14. The dishwasher of claim 5, wherein the bracket further comprises a second blocking wall that protrudes from an inner surface of the bracket and surrounds at least a portion of the first inlet.

15. The dishwasher of claim 14, wherein a least a portion of the second blocking wall is disposed between the first inlet and the valve control module, the second blocking wall being configured to block a condensate on the inner surface of the bracket from discharging through the first inlet.

16. The dishwasher of claim 15, wherein the second blocking wall comprises:

a first part disposed between the first inlet and the valve control module; and a second part that extends from a lower end of the first part and surrounds at least a portion of the first inlet.

17. The dishwasher of claim 14, wherein the bracket further comprises a first support portion that is disposed at the inner surface of the bracket and protrudes from the second blocking wall toward the cover.

18. The dishwasher of claim 17, wherein the first support portion is disposed above the second inlet.

19. The dishwasher of claim 17, wherein the cover comprises a second support portion that is disposed at an inner surface of the cover and protrudes from the inner surface of the cover toward the bracket.

20. The dishwasher of claim 3, wherein the first inlet is one of a plurality of first openings arranged along a vertical direction, and wherein the second inlet is one of a plurality of second openings arranged along a horizontal direction orthogonal to the vertical direction, the plurality of second openings being disposed below the plurality of first openings.

* * * * *